United States Patent [19]

Groft et al.

[11] 4,067,633

[45] Jan. 10, 1978

[54] CAM ACTUATED LOW INSERTION FORCE CONNECTOR

[75] Inventors: James Leon Groft, McSherrystown; William Jeffrey Hudson, Jr., Hershey; Clifton Wesley Huffnagle, Camp Hill, all of Pa.

[73] Assignee: AMP Incorporated, Harrisburg, Pa.

[21] Appl. No.: 752,371

[22] Filed: Dec. 20, 1976

[51] Int. Cl.[2] ..... H01R 13/62

[52] U.S. Cl. ..... 339/74 R

[58] Field of Search ..... 339/74 R, 75 M, 75 MP, 339/176 M, 176 MP

[56] References Cited

U.S. PATENT DOCUMENTS 3,982,807 9/1976 Anhalt et al. ..... 339/176 MP

*Primary Examiner*—Roy Lake
*Assistant Examiner*—Neil Abrams
*Attorney, Agent, or Firm*—Russell J. Egan

[57] ABSTRACT

A cam actuated connector assembly is disclosed for effecting a low insertion force mating of the connector assembly with a plurality of fixed pin or post terminals. The housing includes a first housing member adopted to hold therein a plurality of spring contact terminals and a second housing member receiving the first housing member therein with cam means therebetween for effecting relative movement of the housing members. In the normal relaxed condition of the connector assembly, the contacts are in a closed configuration. Upon actuation of the connector assembly for mating, the housing members are moved relative to one another by the cam means causing the contact terminals to be moved to an open position to receive the mating pin or post terminals. The subsequent release of the second housing member effects a closing of the terminals to an engaged condition.

8 Claims, 7 Drawing Figures

CAM ACTUATED LOW INSERTION FORCE CONNECTOR

BACKGROUND OF THE INVENTION

1. The Field of the Invention

The present invention relates to resilient contact terminals and in particular to a zero on/zero off cam actuated connector assembly.

2. The Prior Art

There are many instances when it is highly desirable to have a low insertion force while mating electrical contacts. Many attempts have been made to solve this problem with various contact and housing configurations designed for mating with different arrays of fixed terminals.

A spring grip contact assembly is shown in U.S. Pat. No. 3,894,783 in which a housing has a cover portion adapted to act on spring terminals to squeeze them into a position where they can accept terminal posts through aligned apertures. The housing is released, after mating, allowing the spring terminals to return toward their normal relaxed condition tightly gripping the terminal posts.

SUMMARY OF THE INVENTION

The present invention relates to a cam actuated connector assembly effecting zero on/zero off mating of a plurality of spring electrical contact terminals with a like plurality of fixed terminal pins or posts. The subject assembly includes a two member housing, one housing member carrying a plurality of spring contact terminals positioned to be acted on by the other housing member when cam actuating means acting therebetween effect relative movement of the housing members. The spring contact terminals have a normal relaxed condition in which they are closed to grip the fixed terminal pins therein. Upon relative movement of the housing members by the cam means, the spring contact terminals are opened to receive a like plurality of fixed terminal pins or posts therein.

It is therefore an object of the present invention to produce an improved electrical connector assembly which requires the application of only a moderate force to actuate a plurality of spring contacts carried thereby so that they can mate with a like plurality of fixed terminal pins with substantially no insertion or extraction force.

It is a further object of the present invention to produce an improved electrical connector assembly which can be mated with a plurality of fixed terminal pins with the application of only a moderate force on the assembly to effect relative movement of housing members and thereby open and close the contacts, substantially no insertion or extraction force being required during mating of the assembly with the fixed pins.

It is another object of the present invention to produce a low insertion force cam actuated connector assembly which can be readily and economically produced.

The means for accomplishing the foregoing objects and other advantages will become apparent to those skilled in the art from the following detailed description taken with reference to the accompanying drawings.

DETAILED DESCRIPTION OF THE PREFERRED EMBODIMENTS

Figure 1:
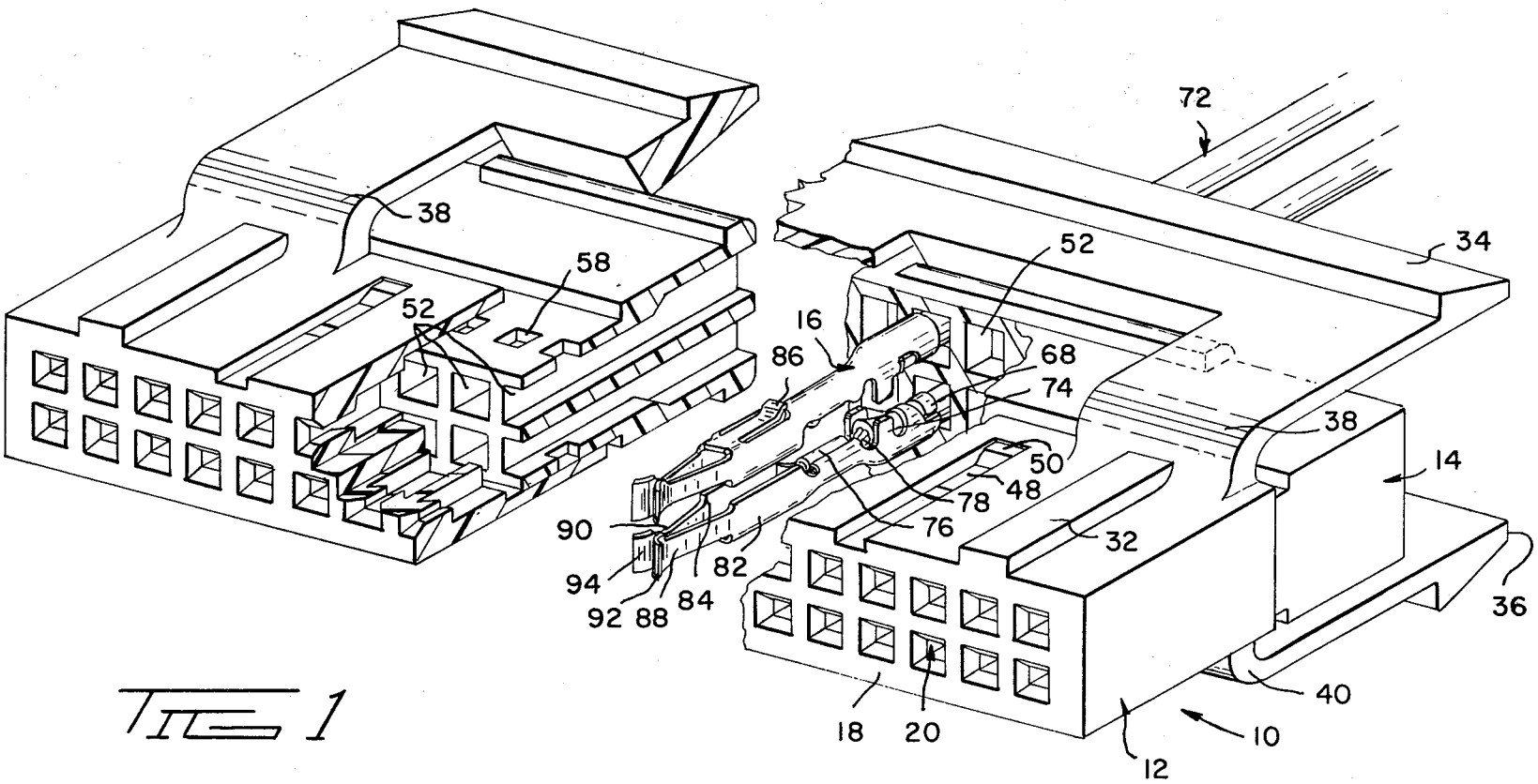
FIG. 1 is a perspective view, partially in section, of a first embodiment of the present invention.

The first embodiment of the subject connector assembly 10 is shown in FIGS. 1 to 5 and includes a first housing member 12, a second housing member 14, and a plurality of contacts 16. The first housing member has a mating face 18 having a plurality of profiled apertures 20 therein. Each aperture has an inwardly tapering entry 22, at the mating face 18, leading to a bore 24 which extends through a pair of inclined contact actuating surfaces 26, 28 which define therebetween a sharp cam edge 30. The first housing member 12 also has at least one outwardly directed keying or polarizing projection 32 and a pair of rearwardly extending handle members 34, 36 which are integrally connected to the first housing member by resilient hinge portions 38, 40, respectively. Each of the handle members 34, 36 has an integral inwardly directed cam surface 42, 44, respectively. The first housing member also includes a profiled cavity 46 which receives the second housing member 14 therein. At least one elongated slot 48 in the first housing member 12 receives an integral stud 50 on the second housing member 14 to both align the housing members properly and to limit their relative movement.

The second housing member 14 has a plurality of contact receiving profiled bores 52 passing therethrough from front face 54 to rear face 56. Each bore is also provided with a latching recess or aperture 58. The rear portion of the housing 14 includes outwardly directed camming surfaces 60, 62 which are aligned for engagement of the cam surfaces 42, 44, respectively, of the first housing member.

Each contact 16 is preferably stamped and formed from conventional sheet metal stock and includes a conductor engaging rear portion 64 and a mating front portion 66. The conductor engaging rear portion 64 includes a first pair of crimp ears 68, for engaging the insulation 70 of conductor 72, a pair of alignment and guiding ears 74, and a second pair of crimp ears 76 adapted to crimpingly engage the stripped wires 78 of conductor 72. The forward end of the connector 16 is essentially channel-shaped with a base 80 and a pair of parallel spaced sidewalls 82, 84. A locking lance 86 is struck from base 80 and a pair of mating spring arms 88, 90 extend forwardly from the sidewalls 82, 84, respectively. On the free end of each arm 88, 90 there is a curved enlargement 92, 94, respectively, which together normally engage and define therebetween a flaring entry to the channel.

Figure 3:
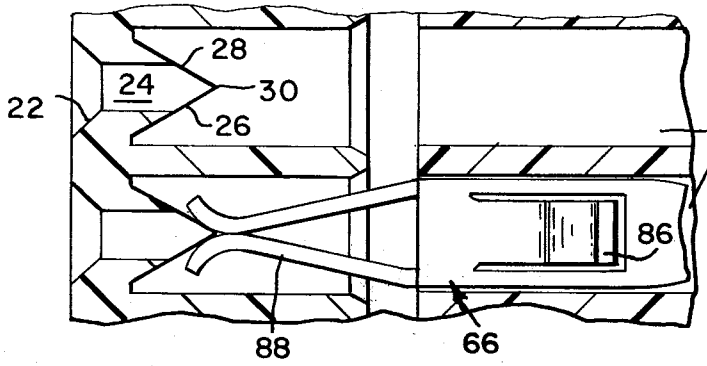
FIG. 3 is a partial horizontal section taken along line 3—3 of FIG. 2 showing a contact in a normal relaxed condition.
Figure 2:
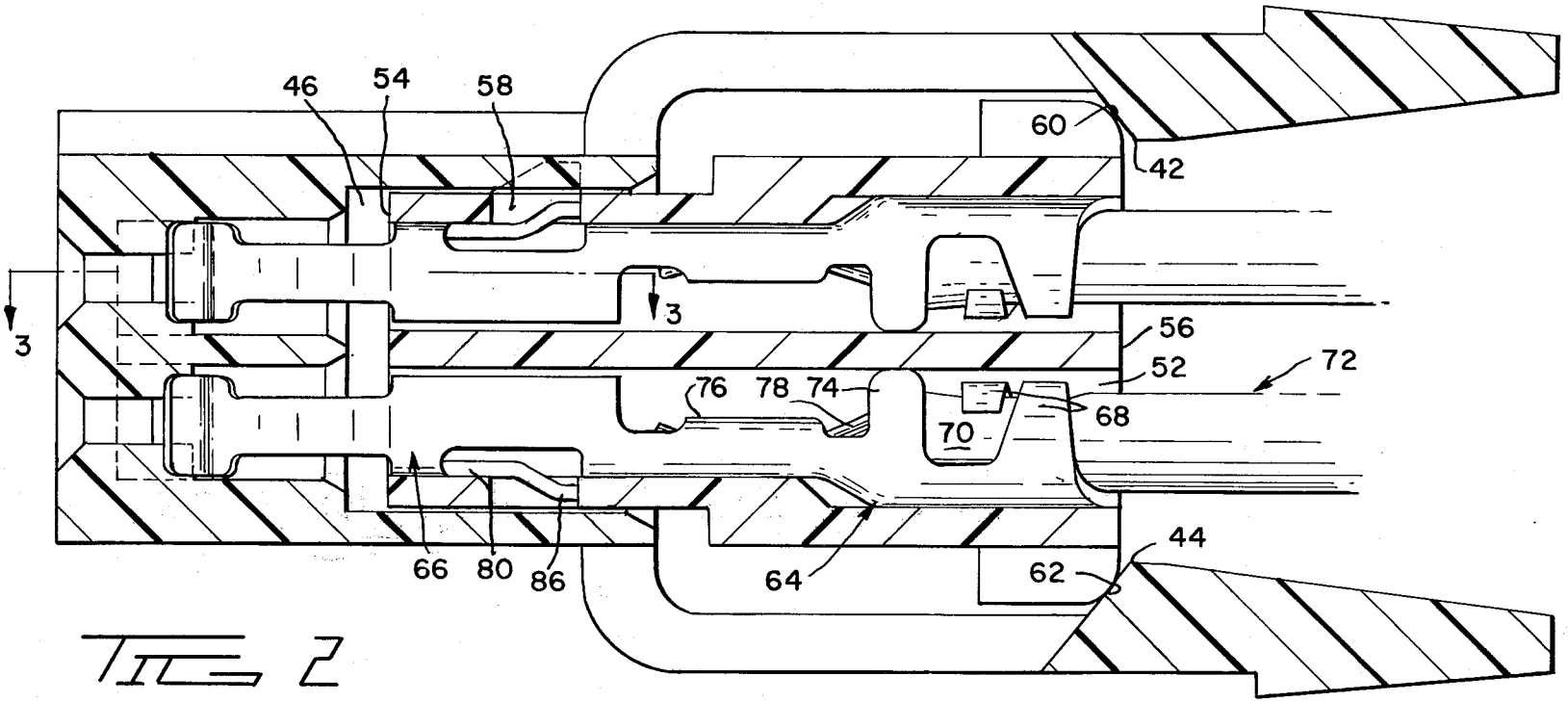
FIG. 2 is a vertical transverse section through the unmated connector assembly of FIG. 1.
Figure 5:
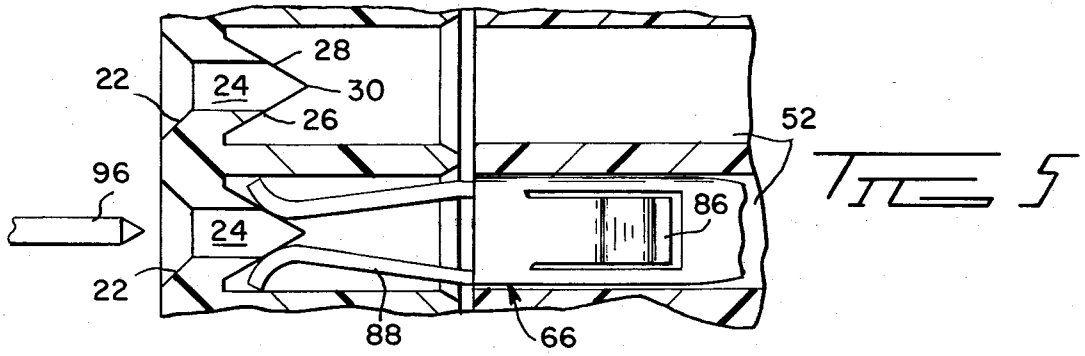
FIG. 5 is a partial horizontal section, similar to FIG. 3, showing a contact in the cammed opened actuated condition ready to be mated with a fixed terminal pin.
Figure 4:
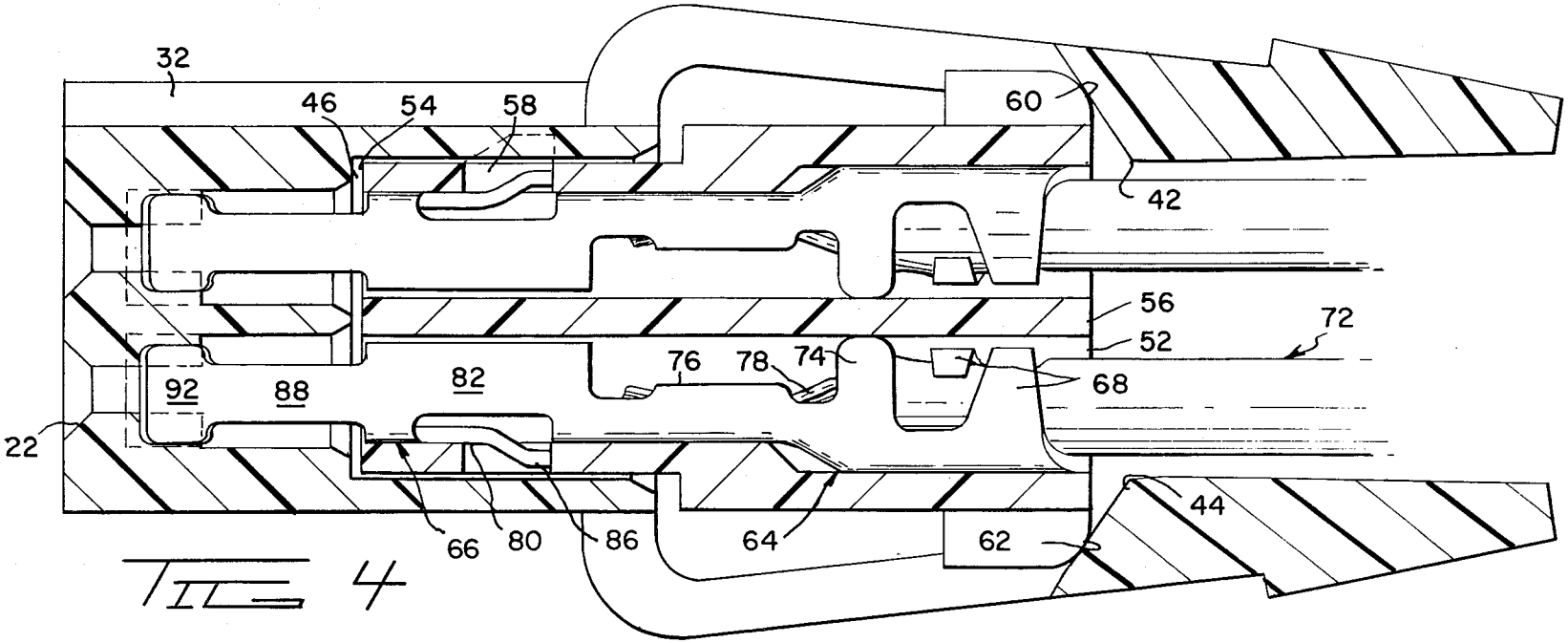
FIG. 4 is a vertical transverse section, similar to FIG. 2, showing the subject connector assembly in an actuated condition ready for mating.

It can be seen from FIGS. 2 and 3 that in the normal relaxed condition of the connector assembly, the contacts will be in their relaxed condition with spring arms 88, 90 preferably in engagement. When the handles 34, 36 are squeezed together, the cam surfaces 42, 44 engage cam surfaces 60, 62, respectively, causing the housing members 12, 14 to be moved relative to one another. The flared ends 92, 94 of the contacts 16 engage the inclined surfaces 26, 28, respectively, causing the contact spring arms 88, 90 to spread thereby allowing the free passage therebetween of the fixed terminal pin or post 96. Release of the handles 34, 36 allows some relaxation of the contact spring arms 88, 90 which withdraw from surfaces 26, 28 for a wiping engagement with the pin or post 96.

Figure 6:
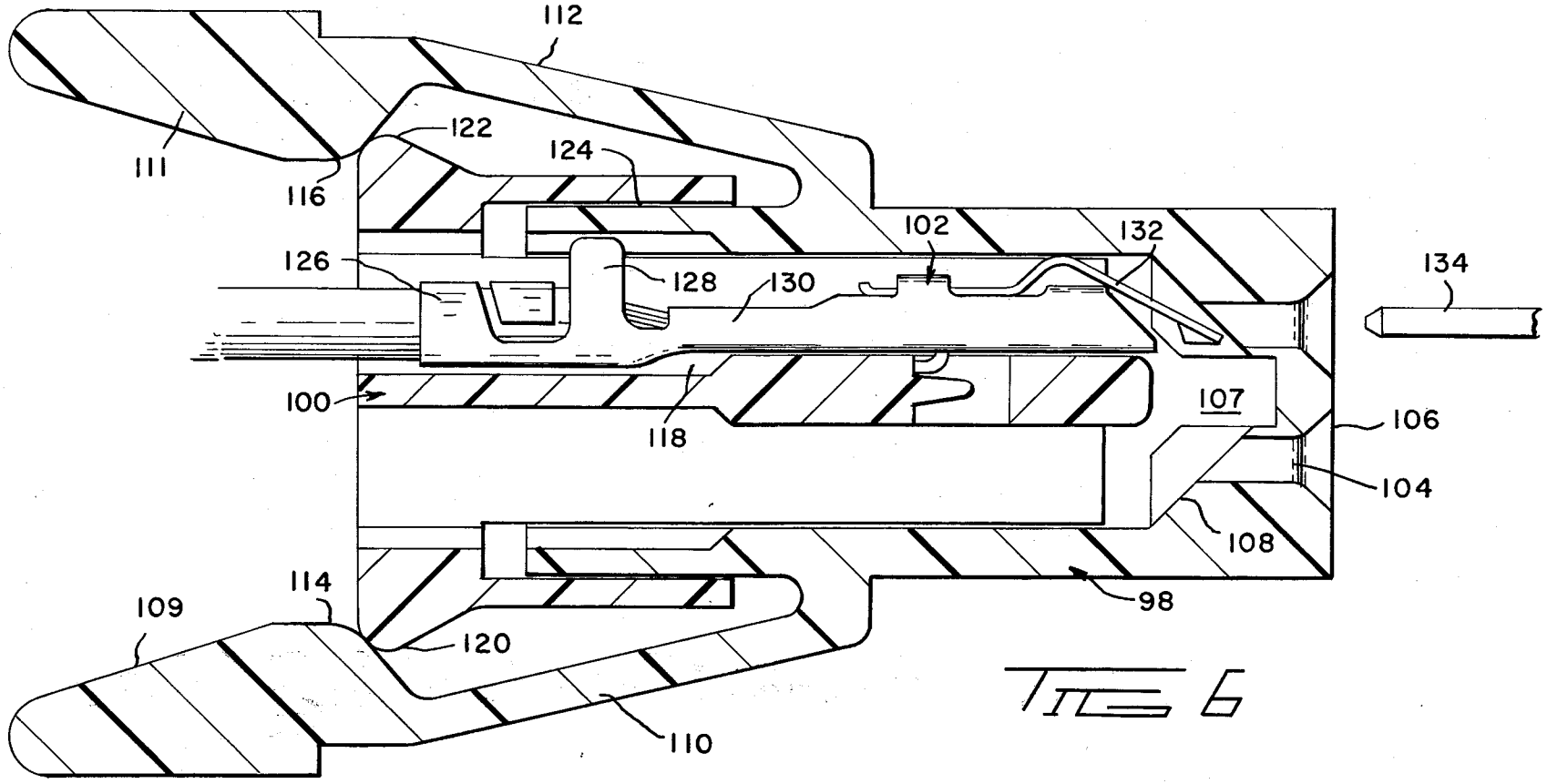
FIG. 6 is a vertical transverse section through a second embodiment of the present invention.
Figure 7:
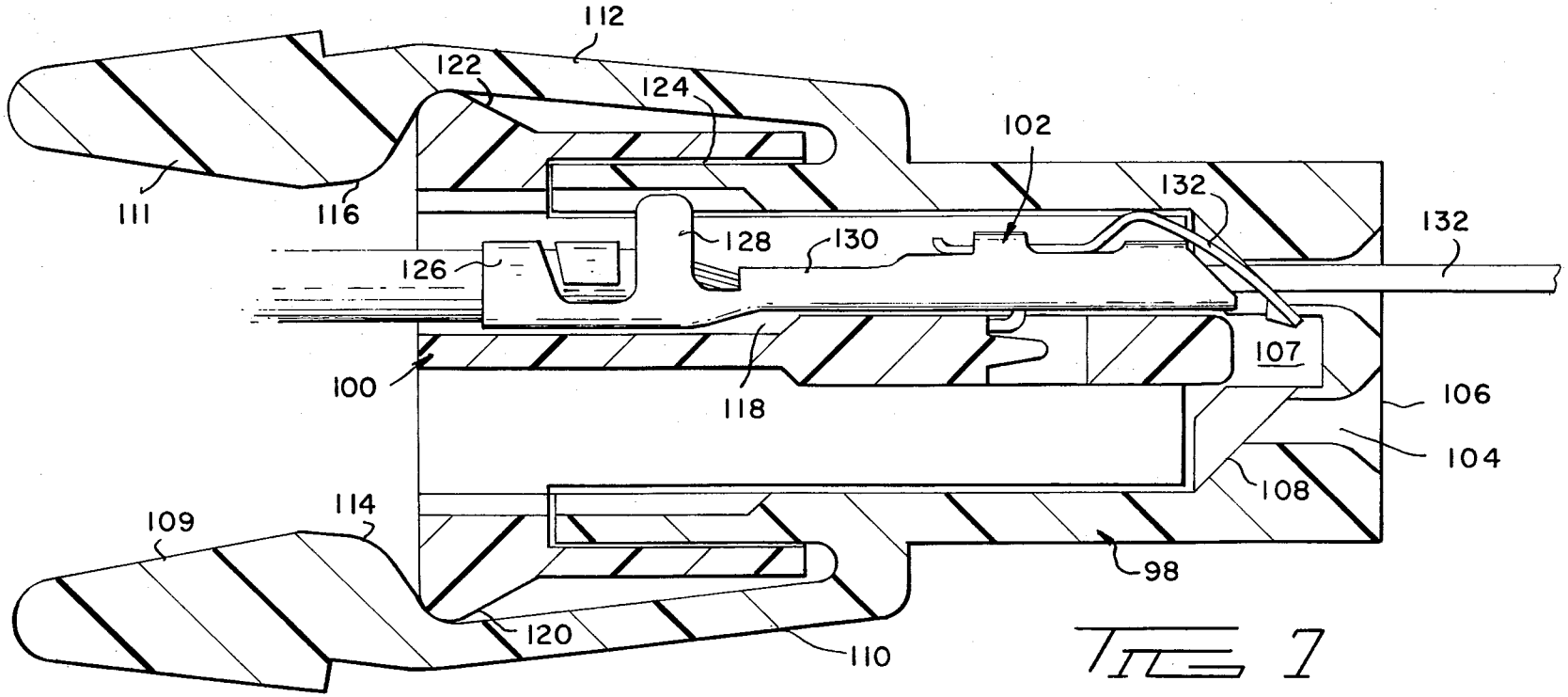
FIG. 7 is a vertical transverse section, similar to FIG. 6, showing the second embodiment of the present invention in an actuated condition ready for mating with fixed terminal pins.

The second embodiment of the present invention is shown in FIGS. 6 and 7 and includes first or outer housing member 98, a second or inner housing member 100, and a plurality of contacts 102.

The first or outer housing 98 includes a plurality of profiled apertures 104 extending from a mating face 106 to a cavity 107 which receives the second or inner housing member 100 therein. An inclined reaction surface 108 is formed to one side of the inner end of each aperture 104. A pair of handles 109, 111 are integrally connected to housing member 98 by resilient hinges 110, 112, respectively. Inwardly directed cam surfaces 114, 116 are formed on handles 109, 111 respectively. The inner housing member 100 includes a plurality of profiled contact receiving passages 118 and a pair of outwardly directed cam surfaces 120, 122 aligned to engage with cam surfaces 114, 116, respectively. The inner housing member can also include some means, such as the profiled flange 124, for alignment purposes with respect to the outer housing member.

In this embodiment the contacts 102 are identical with those described in U.S. Pat. No. 3,705,376, the disclosure of which is incorporated herein by reference. The contacts include insulation engaging tines 126, guide tines 128, wire crimp ears 130 and a cantilever arm 132 having an aperture (not shown) near the free end thereof.

The operation of this embodiment is substantially the same as with the first embodiment. Squeezing the handles 109, 111 together causes cams 114, 116, and 120, 122 to effect relative movement of the housing members. This movement drives the free ends of cantilever arms 132 against surface 108 to be deflected thereby to a position which allows free insertion of terminal post or pin 134.

While the present invention has shown the contacts as being crimped onto conductors, it is well within the scope of the invention to have the conductors engaged with the contacts by the well known insulation displacement or other conventional techniques.

The present invention may be subject to many changes and modifications without departing from the spirit or essential characteristics thereof. The foregoing description should therefore be taken as illustrative only and not restrictive of the scope of the invention.

What is claimed is:

1. A connector assembly for zero on/zero off mating with a plurality of fixed post terminals, said connector assembly comprising:

a first housing member having a mating face on a front end, a cavity depending into an opposite rear end, a plurality of profiled terminal passages extending from said mating face to said cavity including at least one reaction surface facing said cavity, a pair of parallel spaced apart handles resiliently attached to said first housing member extending rearwardly on opposite sides of said cavity, and cam surfaces on the opposed surface of said handles;

a second housing member profiled to be received in said cavity, a plurality of profiled contact receiving passages in said second housing member each aligned with a respective terminal passage in said first housing member, and a pair of oppositely directed cam surfaces aligned to react with said cam surfaces on the handles of said first housing member to effect relative motion between said housing members; and a plurality of spring contacts each having a first end profiled for engagement with a conductor and second mating end including at least one spring arm having a normal relaxed first position, said arm engaging said reaction surface of said first housing member upon relative closing movement of said housing members and being deflected to a second position allowing insertion of a terminal post into said assembly without application of force.

2. A connector assembly according to claim 1 wherein said first housing member further includes an outer profile for polarized mating with a member having a plurality of terminal posts fixedly mounted thereon.

3. A connector assembly according to claim 1 wherein said first housing member includes at least one elongated slot; and said second housing member includes at least one integral stud aligned to extend into said slot whereby said housing members are properly aligned and the relative movement therebetween is defined.

4. A connector assembly according to claim 1 wherein said first end of each said contact includes means for effecting crimped on engagement with an electrical conductor.

5. A connector assembly according to claim 1 wherein said first end of each said contact includes means for effecting insulation displacing engagement with an electrical conductor.

6. A connector assembly according to claim 1 wherein said at least one spring arm is a cantilever beam having an elongated aperture adjacent the free end thereof, engagement of said beam with said reaction surface of said first housing member deflecting said beam sufficiently to align said aperture with said aperture in said first housing member.

7. A connector assembly according to claim 1 wherein said at least one spring arm further comprises a pair of opposed arms extending from opposite side walls of a channel configuration, said arms normally engaging at their free ends, said reaction surface of said first housing member further comprising a pair of intersecting inclined surfaces which cause said arms to spread apart upon relative together movement of said housing members thereby allowing free passage therebetween of a mating terminal pin.

8. A low insertion force connector assembly comprising:

a first housing member having a mating front face, a plurality of terminal pin receiving passages in said mating face, at least one reaction surface on the end of said passages toward the rear of said housing member, a pair of handle members resiliently attached in parallel spaced relation extending from the rear of the housing member with camming surfaces on the opposed faces of each said handle, a second housing member having a like plurality of contact carrying passages each aligned with a respective passage in said first housing member and cam surface means aligned to react with said camming surfaces of said first housing member to cause relative linear motion between said housing members; and a like plurality of contacts each mounted in a respective passage of said second housing member and having a first end portion adapted to electrically and mechanically engage a conductor and a second mating end portion which engages said reaction surface of the first housing member and is acted thereupon to condition it for receipt therein of a fixed terminal post.

* * * * *